United States Patent [19]

Tiramani

[11] Patent Number: 4,936,463

[45] Date of Patent: Jun. 26, 1990

[54] TRAVEL AND STORAGE COSMETIC CASE

[76] Inventor: Paoio M. B. Tiramani, 305 Second Avenue, New York, N.Y. 10003

[21] Appl. No.: 410,487

[22] Filed: Sep. 21, 1989

[51] Int. Cl.[5] ..... A45D 33/28

[52] U.S. Cl. ..... 206/581; 206/235; 132/315

[58] Field of Search ..... 206/373, 315.11, 581, 206/235, 823; 132/314, 315, 316, 317, 286; 312/DIG. 33

[56] References Cited

U.S. PATENT DOCUMENTS

| | | | |
|---|---|---|---|
| 1,600,830 | 9/1926 | Lewis | 312/DIG. 33 X |
| 1,944,502 | 1/1934 | Factor | 132/315 |
| 2,209,781 | 7/1940 | Lewis | 206/581 X |
| 3,350,810 | 11/1967 | Warner et al. | 206/315.11 X |
| 4,717,024 | 1/1988 | Djezovic | 206/581 |

*Primary Examiner*—Paul T. Sewell
*Assistant Examiner*—Jacob K. Ackun, Jr.

[57] ABSTRACT

A travel and storage cosmetic case of the type having side trays pivotally mounted, upon opening of the case, to swing from their internal positions to laterally extending positions, in which the side trays in their internal positions are spaced inwardly of the rear wall, thereby providing clearance for storing "tall" items against the back wall.

3 Claims, 4 Drawing Sheets

TRAVEL AND STORAGE COSMETIC CASE

The present invention relates generally to a travel and storage case for cosmetics and like items, and more particularly to improvements which contribute to an optimum storage capacity while maintaining a desirable compact size and shape.

The within inventive cosmetic case is of the type having side laterally extending trays, in addition to a main storage compartment, to enable storing a wide variety of different shapes and sizes of items. The number of items that can be stored is, of course, increased by having side trays, but these trays occupy positions within the case that complicate being able to store "tall" items, such as containers of hair spray, lotions and shampoos, to note several examples.

EXAMPLES OF THE PRIOR ART

U.S. Pat. No. 4,717,024 issued to Djezovic on Jan. 5, 1988 discloses one method of providing for the storage of tall items in a rear compartment 90. The lid 20 is spherical in shape to provide a large enough compartment or hollow 42 for the tall items, and the side trays 70 and 80 do not swing out from the interior of the organizer but, as noted in column 3, in lines 52, 53 and shown in FIGS. 2 and 3, are stored unattached in device 10 (FIG. 2), and then are attached in laterally extending positions (FIG. 3) to permit access to the sundries stored in these trays.

U.S. Pat. No. 2,209,781 issued to Lewis on July 30, 1940 is noted because it addresses itself to the problem of storing tall items 30 in the "Lady's Beauty Box" illustrated and described therein. The solution is to provide a hinged box member 29 for the items 30 which, as may best be appreciated by successive views FIGS. 3 and 4, pivots forwardly so as to orient the tall items 30 horizontally so that the top 12 can be closed.

In contrast, the within inventive cosmetic case has swing away side trays to thereby provide significant storage space, but these trays do not inhibit storing tall items because their positions, although of course internally disposed within the case, are uniquely arranged to allow the full height of the case to be used for storing these tall items, all as will be more fully explained and illustrated subsequently.

The description of the invention which follows, together with the accompanying drawings should not be construed as limiting the invention to the example shown and described because those skilled in the art to which this invention appertains will be able to devise other forms thereof within the ambient of the appended claims.

Figure 1:
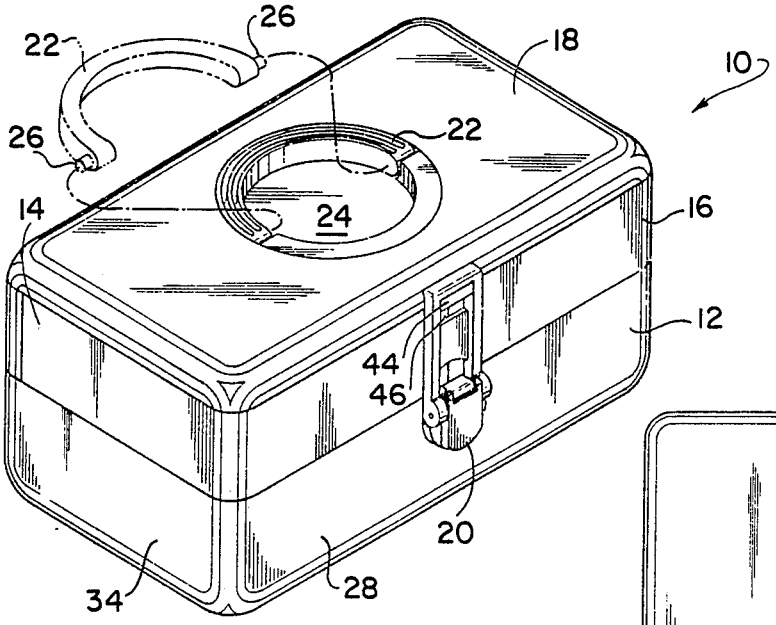
FIG. 1 is a left side perspective view of the within inventive cosmetic case with the lid and swing out trays thereof in their closed position.
Figure 2:
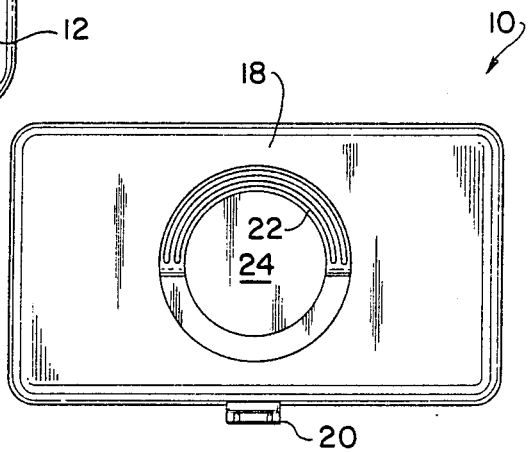
FIG. 2 is a plan view thereof.
Figure 3:
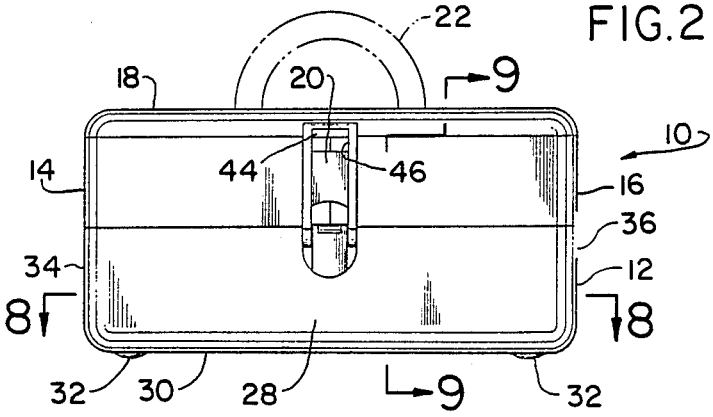
FIG. 3 is a front view thereof.
Figure 4:
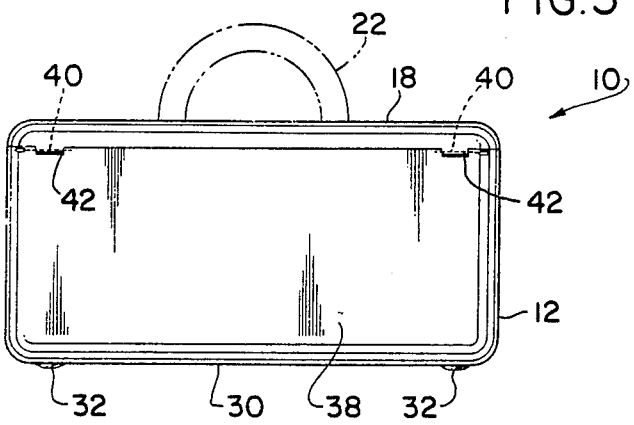
FIG. 4 is a rear elevational view thereof.
Figure 5:
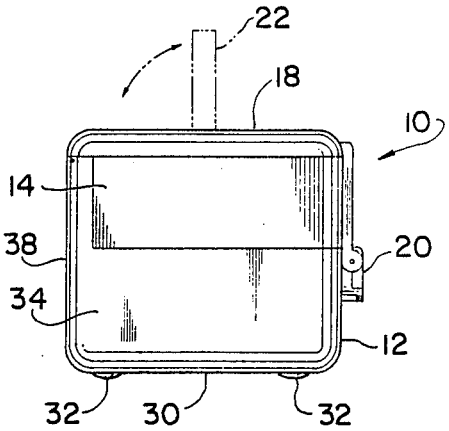
FIG. 5 is a left side elevational view thereof, the right side elevational perspective being a mirror image.
Figure 7:
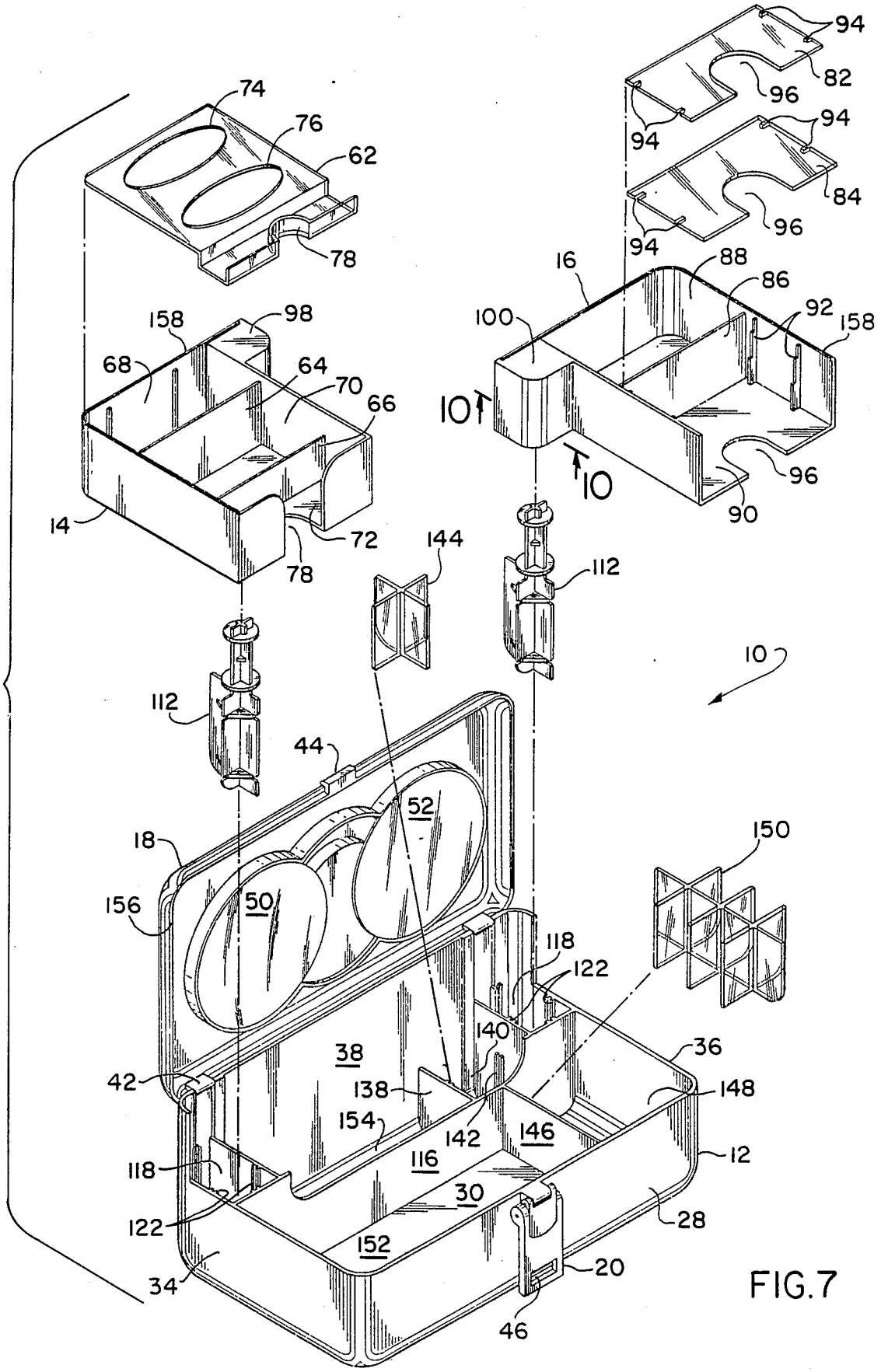
FIG. 7 is a view similar to FIG. 6 but with all product-positioning separable components shown in spaced relation.

As seen in FIG. 1 the within inventive cosmetic carrying case 10 generally consists of a main bottom or body portion 12, which, as best seen in FIG. 7 in conjunction with FIG. 1, it is equipped with a left side swing out tray 14 and a right side swing out tray 16 and to cooperate with said bottom 12 has a hinged and latched lid assembly 18. The entire unit 10, in a preferred commercial embodiment is about the size of a typical shoe box with rounded exterior corners, and is made of molded plastic components except for metal pins used within the lid hinges and latch assembly 20. As illustrated in FIG. 1, a custom designed and commercially available latch assembly 20 is shown retaining lid 18 in contact with trays 14 and 16 as well as aligning these trays flush with the walls of main body portion 12. As illustrated in FIG. 1, it will be understood unit 10 is ready for storage or transport. A handle 22 is shown in its horizontal position within well 24 in which position it is flush with the top plane of lid 18. Handle 22 has integrally molded pivot pins 26 which snap fit into cooperating holes (not shown) within well 24. Handle 22 is thus free to pivot to the vertical position as shown in phantom line in FIGS. 3, 4 and 5.

Figure 6:
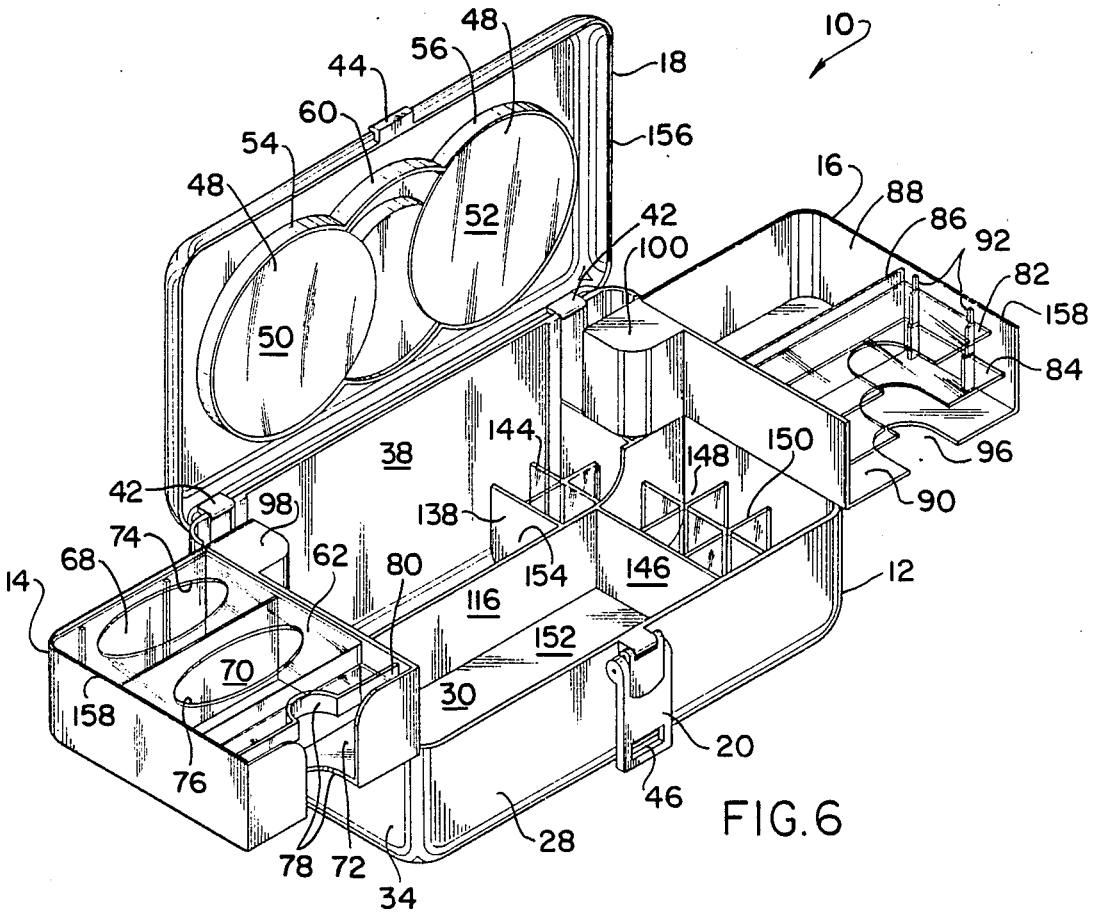
FIG. 6 is a perspective view similar to FIG. 1, but showing the cosmetic case made ready for use, i.e. with the lid open and both swing out trays disposed laterally outward.

Now referring to the open condition of the case as shown in FIG. 6, it can be seen that this results from latch 20 having been opened on case 10, lid 18 having been lifted to a slightly more than 90 degree open position, and trays 14 and 16 having been rotated 90 degrees horizontally to the left and right respectively. In this "open" mode or condition, the interior space delineation or arrangement of case 10 provides ready access to many cosmetic and sundry items customarily of personal use.

Figure 8:
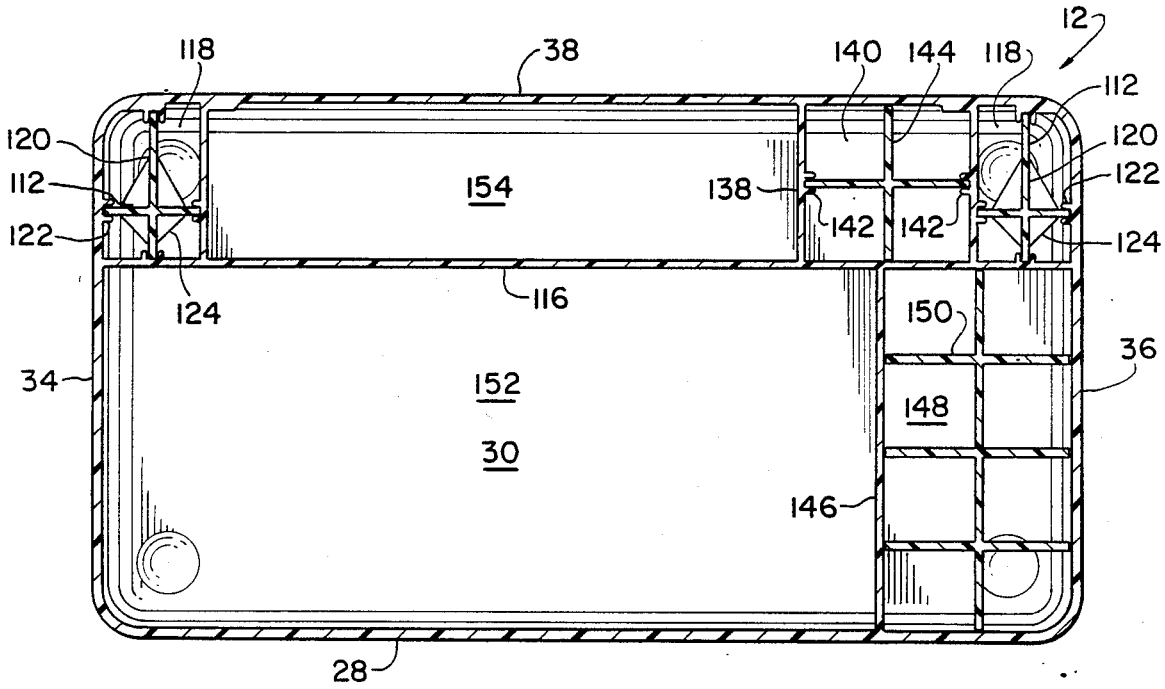
FIG. 8 is a sectional view of the cosmetic case as taken along line 8—8 of FIG. 3.
Figure 9:
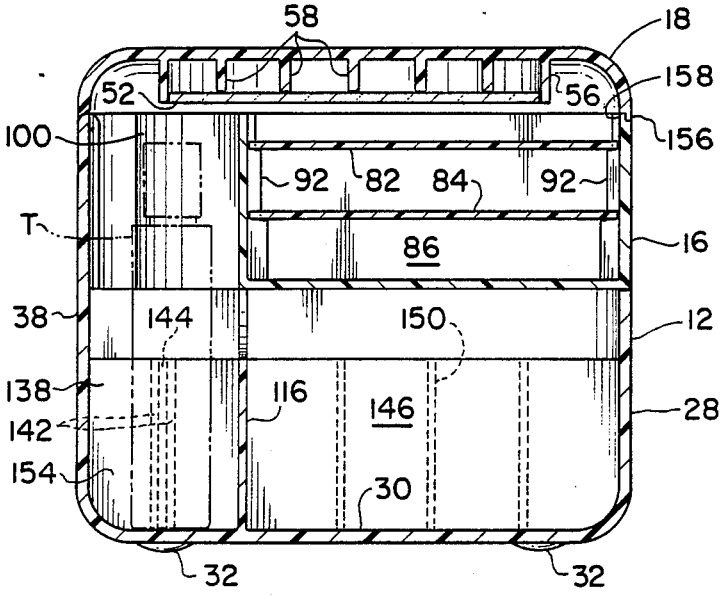
FIG. 9 is another sectional view as taken along line 9—9 of FIG. 3.

As seen best in FIGS. 7, 8 and 9, the storage compartment of the main body portion 12 is bounded by a front wall 28 from which latch 20 extends, a bottom wall 30 which includes four molded glides 32, left and right side walls 34 and 36 respectively, and a rear wall 38 which extends upwardly adjacent lid 18. Wall 38 is molded with holes to receive hinge pins 40 (FIG. 4) which laterally extend from hinge extensions 42 on lid 18.

Lid 18 formed essentially as a thin rectangular member, has a latch tongue extension 44 located in the center of its front edge to engage aperture 46 of latch assembly 20. Also on lid 18, and as previously described, is a well 24 and handle 22. On its underside lid 18 is fitted with a pair of mirrors 48. The left mirror surface 50 is of the concave type which provides the user with a magnified close-up reflection when desired. The right mirror surface 52 is of the flat conventional variety. Mirror surfaces 50 and 52 can be made of plastic or of glass. Mirrors 48 are seated and cemented within walls 54 and 56 and rest on molded ribs 58 as best seen in FIG. 9. Alternately, but not shown, lid 18 may be assembled with only a single mirror 48 within wall 60 and be adhesively attached to the interior wall of well 24.

The left swing out tray 14 is shown laterally disposed in FIG. 7 and with its box like structure beneath a space-delineating top insert 62 removed therefrom. Within tray 14 a first wall 64 and a second wall 66 form a rear compartment 68, an intermediate compartment 70 and a front compartment 72. When top insert 62 is in place (FIG. 6) compartment 68 may be used to store and dispense facial tissues through aperture 74 while compartment 70 is recommended to be used to store and dispense cotton balls through aperture 76. Compartment 72 is specially designed to store and dispense cotton tipped swabs. Cutouts 78 provide finger access to the stored swabs and clearance 80 facilitates the removal thereof.

Similarly, the right swing out tray 16 as illustrated in FIG. 7, is shown with its boxlike structure beneath appropriately shaped and sized shelf inserts 82 and 84. Within tray 16 a vertical wall 86 separates a rear compartment 88 and a front compartment 90. Within compartment 90 four molded step ribs 92 (also see in FIG. 9) are provided to support shelf inserts 82 and 84. Each shelf 82 and 84 has corresponding notches 94 which fit about ribs 92 for positive engagement. Finger clearance cutouts 96 provide the user with access to compacts or the like stored between shelves 82 and 84, while rear compartment 88 can be used to store small jars and similar miscellaneous items.

Still referring to FIG. 7, it will be noted that on the inboard face of each swing out tray 14 and 16 there is a prominent extension 98 and 100 respectively. Extensions 98 and 100 are pivot housings and are identically constructed except to account for left and right hand function and orientation. For brevity's sake therefore, only pivot housing 100 will be described in connection with FIGS. 10 and 11.

Figure 10:
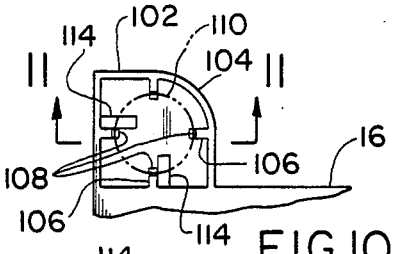
FIG. 10 is a partial view of the right swing out tray pivot housing as seen from below in the direction of the line 10—10 of FIG. 7.
Figure 11:
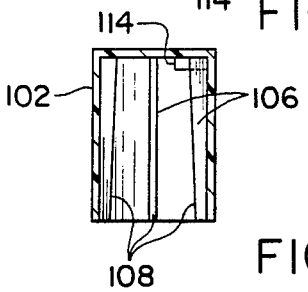
FIG. 11 is a sectional view taken along line 11—11 of FIG. 10.
Figure 13:
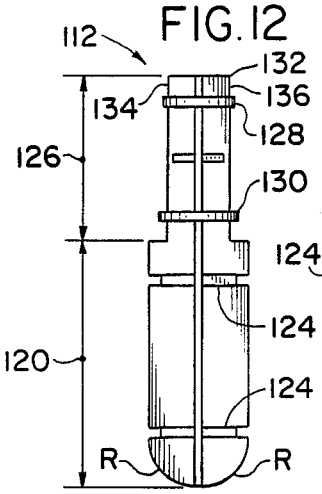
Figure 14:
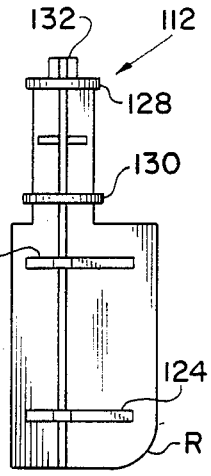

Housing 100, as seen from underneath in FIG. 10, is generally a square box 102 except for one radiused corner 104. On the center of each of the four walls of box 102 a vane 106 is molded, such that the four vanes 106 each presents a bearing face 108. Except for a slight interior taper (FIG. 11) to accommodate molding practice, the bearing faces 108 in assembly come to bear on a cylinder 110 which, as will be subsequently described serves as a housing for a pivot post 112, as shown in FIGS. 13 and 14. At the base of two of the vanes 106 is a pair of strategically located blocks 114 which cooperate with pivot post 112 and limit the angular movement of tray 16 to 90 degrees, between closed and open position.

Reference is now made to the cross sectional FIG. 8 view of the body portion 12. At the extreme left and right ends of a traverse wall 116, a rectangular receptacle 118 is formed to receive the criss cross-shaped base 120 of each pivot post 112. Each of the four legs of base 120 nests snugly within a pair of tracks 122 provided on the four interior walls of receptacle 118. As seen in detail in FIGS. 12, 13 and 14, three of the four legs of base 120 are made with a radius "R" sized to fit either the left or the right receptacle 118. Triangular webs 124 are used to reinforce the legs of base 120.

The cylinder 110 or upper section 126 of pivot post 112 is made in conformance with conventional molding practice wherein the edges of flanges 128 and 130 provide the bearing surfaces that cooperate with surfaces on the internal vanes 106 within pivot housing 98 and 100 and permit pivotal or a rotational degree of movement. Vertical continuation of the legs on base 120 provide the structure to support flanges 128 and 130.

Figure 12:
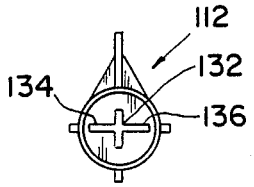
FIGS. 12, 13 and 14 are respectively a plan view, a front elevational view and a right side elevational view of a pivot post used to pivotal support each of the two swing out trays.

As seen best in FIGS. 12 and 13, a criss cross-shaped extension 132 at the very top of pivot post 112 serves as a support or bearing for the trays 14 and 16, and, to this end, has a left side vane 136 and a right side vane 134. As indicated in FIG. 7, two identically constructed pivot posts 112 are used to support each of the trays 14 and 16. When assembled, a post 112 is beneath and thus supports tray 14 and vane 134 thereon cooperates with stop blocks 114 within pivot housing 98 to limit the angular traverse of tray 14. Similarly, when a post 112 is used to support tray 16, vane 136 thereon cooperates with stop blocks 114 within pivot housing 100 of tray 16 to limit its angular extremes.

To summarize briefly, in practice, each of a pair of pivot posts 112 is securely anchored within left and right receptacles 118, whereupon swing out trays 14 and 16 by being mounted on said posts 112 can be freely pivoted outwardly within the limits of integral stop means 114 and 132.

Main body portion 12 is further divided by a small traverse partition 138 (FIGS. 6, 7 and 8) which forms to its right a compartment 140. Compartment 140 is made with guide tracks 142 for the retention of a four paneled insert 144. The sub compartments formed by insert 144 are intended for the storage of long, thin items such as brushes, mascaras, eyeliners and the like.

Likewise, another partition 146 forms a compartment 148 within main body portion 12 (FIGS. 6, 7 and 8). A sub divider insert 150 is made to fit snugly within compartment 148 and is intended for the storage of assorted lipsticks.

The balance of main body portion 12 is devoted to providing a forward compartment 152 for the storage of a blow dryer, brushes, combs and such sundry items, and to providing a rear compartment or storage bin 154. The back bin 154 is especially shaped and sized for providing for the storage of tall objects such as containers of hair spray, lotions and shampoos and to this end stores these objects against back wall 138. It is noted in FIG. 9 that even when lid 18 is closed, that the internally disposed trays 14 and 16 are in a spaced clearance position from the back wall 38 to allow access to the space above bin 154 for the stored tall objects T shown in phantom perspective in FIG. 9.

Stated another way, each housing 98 and 100 for the respective trays 14 and 16 are attached to extend rearwardly of the rearwardly disposed wall of each tray, so that when the trays 14 and 16 are fully disposed within the confines of the case bottom 12 and lid 18, the said rearwardly disposed tray walls are advantageously spaced, to the extent of the size of the housings 98, 100, from the case rear wall 38, and thus in these clearance positions do not inhibit the use of the full height of the case base 12 and lid 18 for the storage of the tall items T. This, thus, significantly contributes to the utility of the within cosmetic case as a convenience article of manufacture.

After a typical contemplated use, when the cosmetic articles have been properly replaced, the user can rotate trays 14 and 16 to their closed position, close lid 18, and secure latch 20. In FIG. 9, it is to be noted that an extension lip 156 on the front and side edges of lid 18 engages a mating lip 158 on the top edge of the "outside" walls of trays 14 and 16 to assist in holding the trays 14 and 16 in place, particularly during transport.

Inserts 62, 82, 84, 144, and 150 in the shapes and sizes as shown are preferably molded in clear plastic, but also may be made of colored plastic to match or contrast with the colored plastic of lid 18, body portion 12 and swing out trays 14 and 16. Additionally, as best seen in FIG. 7, the construction of the present invention allows for too less disassembly and reassembly of the components which, in turn, greatly facilitates cleaning.

As described and illustrated, it should be readily appreciated that case 10 is a noteworthy article of convenience for storage and transportation of cosmetics and sundry personal grooming and related items. Among its significant advantages over prior art cosmetic cases is its accommodation of even "tall" items, while with swing away trays and delineated compartments, it also can accommodate a wide variety of other sizes and shapes of items.

While the particular cosmetic case herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In a travel and storage cosmetic case of the type having a hinged lid and bottom bounding a storage compartment and a pair of intermediate pivotally mounted swing away side trays, the improvements comprising a side tray pivot means for each said side tray located in opposite rear corners of said storage compartment, and each said side tray being mounted in a forwardly disposed position on a cooperating one said side tray pivot means so as to have an operative position of pivotal movement when within the confines of said storage compartment that is in a clearance position from a rearwardly disposed wall bounding said storage compartment, said clearance distance corresponding to the extent of the width size of said pivot means, whereby any tall items stored in said cosmetic case can extend the height of said bottom and lid through said clearance between said side trays and said storage compartment rear wall.

2. A travel and storage cosmetic case as claimed in Claim 1 including a transversely oriented wall in said bottom in spaced relation to said case rear wall to form a compartment for said tall items beneath said clearance space.

3. A travel and storage cosmetic case as claimed in Claim 1 wherein each said side tray pivot means is comprised of a cylindrical stationary post and a circular housing disposed in unattached covering relation thereon, and each side tray is attached to a cooperating one said circular housing so as to partake of pivotal movement incident to the rotational movement of said housing about one said post.

* * * * *